US009130331B2

(12) United States Patent
Umemura et al.

(10) Patent No.: US 9,130,331 B2
(45) Date of Patent: Sep. 8, 2015

(54) ROTATING CONNECTOR

(71) Applicant: YAZAKI CORPORATION, Minato-ku, Tokyo (JP)

(72) Inventors: Masakazu Umemura, Makinohara (JP); Hideki Adachi, Makinohara (JP); Tomoyoshi Kikkawa, Makinohara (JP); Hiraku Tanaka, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 225 days.

(21) Appl. No.: 13/912,246

(22) Filed: Jun. 7, 2013

(65) Prior Publication Data

US 2013/0330946 A1 Dec. 12, 2013

(30) Foreign Application Priority Data

Jun. 11, 2012 (JP) ..... 2012-131888

(51) Int. Cl.
*H01R 3/00* (2006.01)
*H01R 35/02* (2006.01)

(52) U.S. Cl.
CPC ..... *H01R 35/025* (2013.01)

(58) Field of Classification Search
USPC ..... 439/164, 15
IPC ..... B60R 16/027; H01R 35/025,35/04, H01R 2201/126; H02G 11/00
See application file for complete search history.

(56) References Cited

U.S. PATENT DOCUMENTS

| | | | | |
|---|---|---|---|---|
| 5,224,871 | A * | 7/1993 | Ida et al. | 439/164 |
| 5,669,777 | A * | 9/1997 | Matsumoto et al. | 439/164 |
| 5,882,216 | A * | 3/1999 | Matsumoto et al. | 439/164 |
| 7,393,222 | B2 * | 7/2008 | Asakura | 439/164 |
| 2002/0025706 | A1 | 2/2002 | Kikkawa | |
| 2013/0095671 | A1 | 4/2013 | Arakawa | |

FOREIGN PATENT DOCUMENTS

| | | | |
|---|---|---|---|
| CN | 1750333 | A | 3/2006 |
| CN | 101106243 | A | 1/2008 |
| CN | 101361237 | A | 2/2009 |
| CN | 102823096 | A | 12/2012 |
| JP | H09-63732 | A | 3/1997 |
| JP | 2003-230223 | A | 8/2003 |

OTHER PUBLICATIONS

The Chinese office action letter issued on Feb. 15, 2015 in the counterpart Chinese patent application.

* cited by examiner

*Primary Examiner* — Hien Vu

(74) *Attorney, Agent, or Firm* — Marvin A. Motsenbocker; Mots Law, PLLC

(57) ABSTRACT

A rotating connector includes a cable accommodation chamber formed between an outer case and an inner case in their radial direction, a flexible flat cable housed in the cable accommodation chamber, and multiple idlers housed in the cable accommodation chamber. The idlers are rotatably provided in a direction of an annular slidable member. The idlers are rotatable on their own axes. The flat cable is wound on an inner periphery of the outer case and an outer periphery of the inner case by way of a reversed portion of the flat cable. The flat cable is wound thereon in opposite directions. The idlers are pivotally supported by the slidable member so as to change a space between the idlers and the inner case and a space between the idlers and the outer case depending on winding of the flat cable.

4 Claims, 3 Drawing Sheets

ROTATING CONNECTOR

CROSS REFERENCE TO RELATED APPLICATIONS

This application claims priority to Japanese Patent Application No. 2012-131888 filed on Jun. 11, 2012, the entire contents of which are incorporated by references herein.

BACKGROUND OF THE INVENTION

1. Field of the Invention

The present invention relates to a rotating connector applied to a vehicle.

2. Description of the Related Art

A rotating connector is generally used in a steering system of a vehicle and the like. Japanese Patent Application Publication No. 2003-230223 (Patent Document 1) discloses a rotating connector. This rotating connector includes a cylindrical outer case, a cylindrical inner case, a flexible flat cable and multiple idlers. The inner case is housed in the outer case in such a manner as to be concentric with the outer case and rotatable relative to the outer case. A cable accommodation chamber is formed between the inner case and the outer case. The flat cable is housed in the cable accommodation chamber, and wound along the inner periphery of the outer case and along the outer periphery of the inner case. A direction in which the flat cable is wound along the inner periphery of the outer case is made opposite to a direction in which the flat cable is wound along the outer periphery of the inner case by way of a reversed portion of the flat cable. The multiple idlers are rotatably housed in the cable accommodation chamber, and provided in a circumferential direction of an annular slidable member in a way that the idlers are rotatable their own axes, the annular slidable member being configured to reverse the flat cable.

In the rotating connector, the flat cable is wound by the multiple idlers in the cable accommodation chamber. When the flat cable is wound along the inner periphery of the outer case, the flat cable is housed in a space between the outer case and the multiple idlers in the radial direction. When the flat cable is wound along the outer periphery of the inner case, the flat cable is housed in a space between the inner case and the multiple idlers in the radial direction.

SUMMARY OF THE INVENTION

Meanwhile, in the rotating connector shown in Patent Document 1, the space between the multiple idlers and each of the outer and inner cases is set large to such a extent that the flat cable can be housed while maximizing the number of turns of the flat cable along the inner periphery of the outer case and the number of turns of the flat cable along the outer periphery of the inner case.

However, when the space between the multiple idlers and each of the outer and inner cases is set large, the following problems are likely to occur. In a case where the inner case is rotated in the reverse direction after the flat cable is wound along the inner periphery of the outer case to the maximum, it is more likely that the reversed portion of the flat cable enters the space between the outer periphery of the inner case and the multiple idlers in the radial direction, and as a result, the flat cable may be buckled. Similarly, in a case where the inner case is rotated in the reverse direction after the flat cable is wound along the outer periphery of the inner case to the maximum, it is more likely that the reversed portion of the flat cable enters the space between the inner periphery of the outer case and the multiple idlers in the radial direction, and as a result, the flat cable may be buckled. In these cases, the durability of the flat cable is apt to decrease.

An object of the present invention is to provide a rotating connector which is capable of inhibiting a decrease in durability of a flat cable.

An aspect of the present invention is a rotating connector comprising: a cylindrical outer case; a cylindrical inner case housed in the outer case, the inner case being rotatable relative to the outer case; a cable accommodation chamber formed between the outer case and the inner case in a radial direction of the outer case and the inner case; at least one flexible flat cable housed in the cable accommodation chamber, and the flexible flat cable being wound along an inner periphery of the outer case and an outer periphery of the inner case by way of a reversed portion of the flat cable, and being wound along the inner and outer peripheries in opposite directions; and a plurality of idlers housed in the cable accommodation chamber, the idlers being rotatably provided in a circumferential direction of an annular slidable member, the idlers being rotatable on their own axes to reverse the flat cable, and pivotally supported by the slidable member so as to change a space between the idlers and the inner case and a space between the idlers and the outer case change in the radial direction in accordance with winding of the flat cable.

The plurality of idlers may be pivotally supported so as to minimize the space between the idlers and the inner case when the number of turns of the flat cable along the inner periphery of the outer case is maximized and so as to minimize the space between the idlers and the outer case when the number of turns of the flat cable along the outer periphery of the inner case is maximized.

A plurality of the flat cables may be housed in the cable accommodation chamber.

According to the present invention, it is possible to provide a rotating connector which is capable of inhibiting a decrease in durability of a flat cable.

DESCRIPTION OF THE PREFERRED EMBODIMENTS

Figure 1:
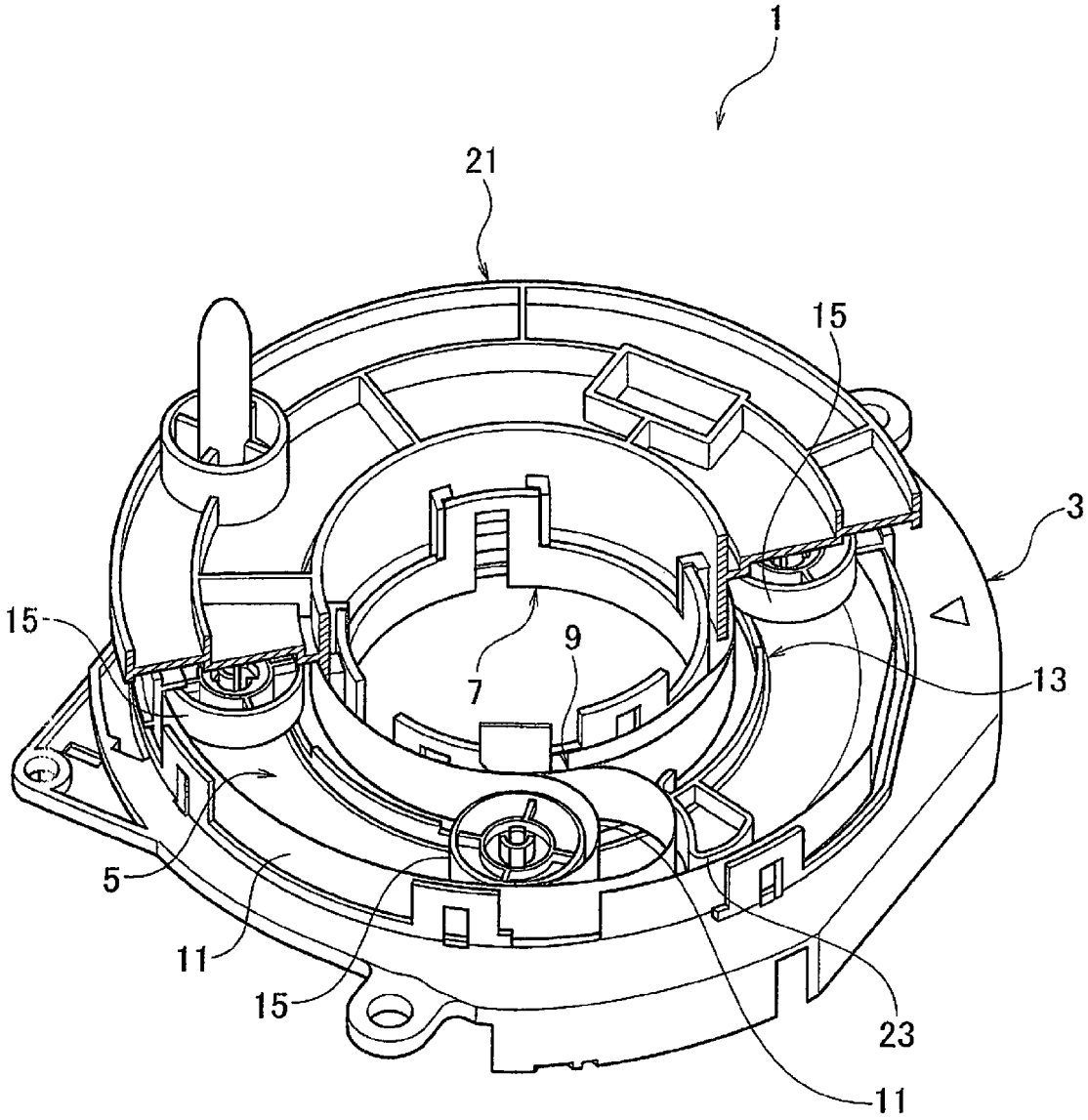
FIG. 1 is a perspective view of a rotating connector of an embodiment of the present invention.

Descriptions will be provided for a rotating connector of an embodiment of the present invention by use of FIGS. 1 to 4.

A rotating connector 1 of the embodiment includes a cylindrical outer case 3, a cylindrical inner case 7, a cable accommodation chamber 5, one or more flexible flat cables 11, and multiple idlers 15. The inner case 7 is housed in the outer case and rotatable relative to the outer case 3. The cable accommodation chamber 5 is formed between the outer case 3 and the inner case 7 in the radial directions of the outer case 3 and the inner case 7. The one or more flexible flat cables 11 are housed in the cable accommodation chamber 5, and wound along the inner periphery of the outer case 3 and along the outer periphery of the inner case 7. A direction in which the one or more flat cables 11 are wound along the inner periphery of the outer case 3 is made opposite to a direction in which the one or more flat cables 11 are wound along the outer periphery of the inner case 7 by way of a reversed portion or portions of the one or more flat cables 11. The multiple idlers 15 are housed in the cable accommodation chamber 5, and rotatably provided in a circumferential direction of an annular slidable member 13. Further, the idlers 15 are rotatable in their own axes for the purpose of reversing the one or more flat cables 11.

In addition, the multiple idlers 15 are pivotally supported by the slidable member 13 so as to change a space 17 between the idlers 15 and the inner case 7 in the radial direction of the inner case 7 and a space 19 between the idlers 15 and the outer case 3 in the radial direction of the outer case 3 in accordance with winding (turns) of the one or more flat cables 11.

As described later, the multiple idlers 15 may be pivotally supported so as to minimize the space 17 between the idlers 15 and the inner case 7 when the number of turns of the one or more flat cables 11 along the inner periphery of the outer case 3 is maximized; and so as to minimize the space 19 between the idlers 15 and the outer case 3 when the number of turns of the one or more flat cables 11 along the outer periphery of the inner case 7 is maximized.

As described later, two or more flat cables 11 may be housed in the cable accommodation chamber 5.

Figure 2A:
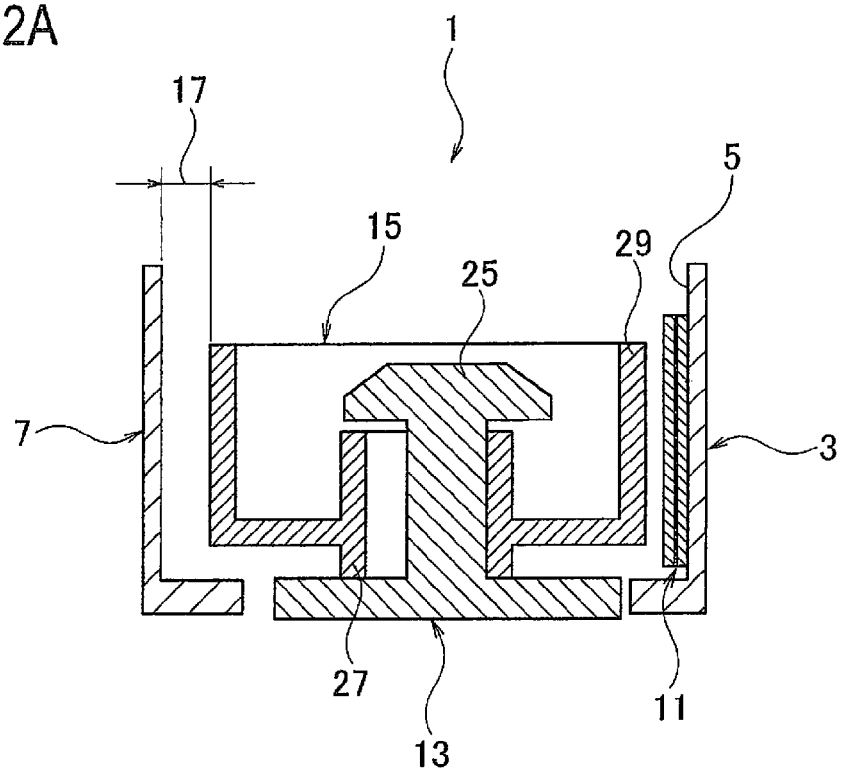
FIG. 2A is a cross-sectional view of an idler in the rotating connector of the embodiment of the present invention when the idler moves toward an inner case.
Figure 2B:
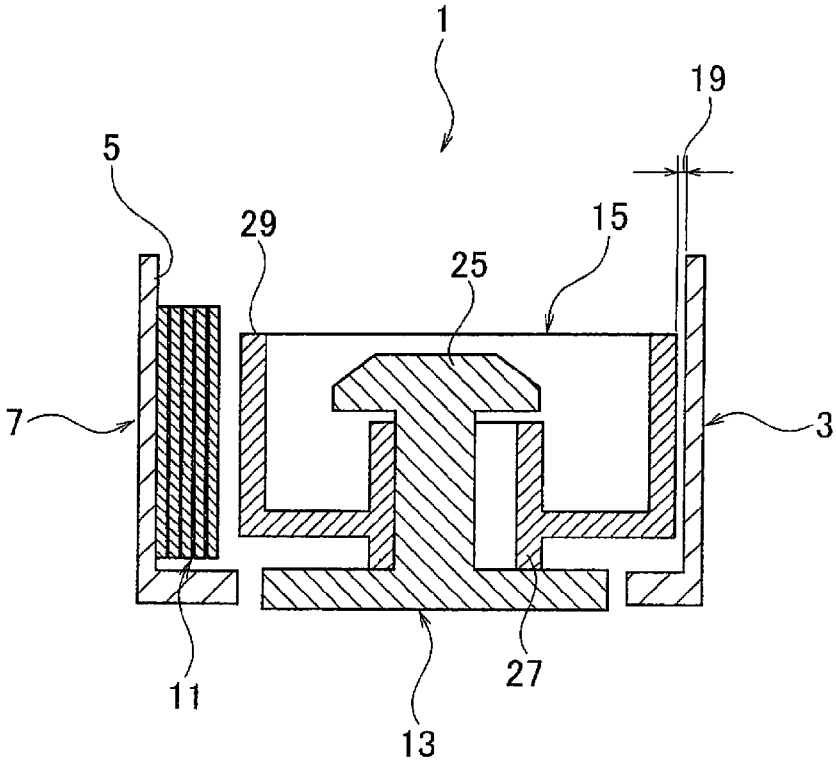
FIG. 2B is a cross-sectional view of the idler in the rotating connector of the embodiment of the present invention when the idler moves toward an outer case.
Figure 3:
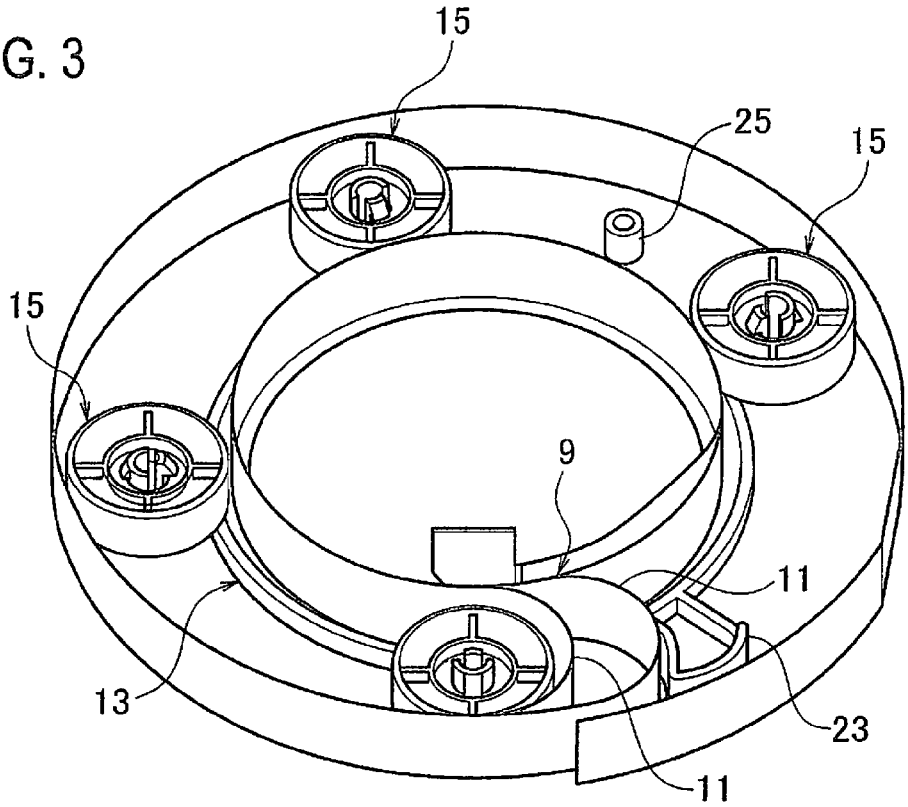
FIG. 3 is a perspective view of the rotating connector of the embodiment of the present invention, which has two flat cables.

As shown in FIGS. 1 to 3, the outer case 3 has a peripheral wall which is shaped like a cylinder, and is fixed to a vehicle body (not illustrated) such as a steering column. The inner case 7 is housed in a bore of the peripheral wall of the outer case 3, and is rotatable relative to the outer case 3.

The inner case 7 is shaped like a cylinder, and is fixed to a rotary body (not illustrated) such as a steering wheel in a way that the inner case 7 is rotatable integrally with the rotary body. The cable accommodation chamber 5 is formed between the outer periphery of the inner case 7 and the inner periphery of the peripheral wall of the outer case 3 in the radial direction. The multiple (two in this case) flat cables 11 are housed in the cable accommodation chamber 5. The upper surface of the cable accommodation chamber 5 is closed with a lid member 21 which is fixed to the inner case 7 in a way that the lid member 21 is rotatable integrally with the inner case 7.

Each flat cable 11 is formed in a belt shape by placing multiple conductors on a flexible insulating sheet. One end of the flat cable 11 is fixed to the peripheral wall of the outer case 3 and is electrically connected to a circuit in the vehicle body. The other end of the flat cable 11 is fixed to the inner case 7 and is electrically connected to a circuit in the rotary body. It should be noted that of the two flat cables 11, one is connected to a circuit of an airbag while the other is connected to a general circuit, for example.

The flat cables 11 are housed in the cable accommodation chamber 5 in a way that: the flat cables 11 are wound along the inner periphery of the outer case 3, and along the outer periphery of the inner case 7; and the direction in which the flat cables 11 are wound along the inner periphery of the outer case 3 is made opposite to the direction in which the flat cables 11 are wound along the outer periphery of the inner case 7 are made opposite by the slidable member 13 and the multiple idlers 15, and by way of the reversed portions of the respective flat cables 11.

The slidable member 13 is shaped like a ring and is rotatably placed in the cable accommodation chamber 5. In addition, the slidable member 13 is provided with a guide portion 23 configured to guide the flat cables 11 in order that the flat cables 11 can be wound around the multiple idlers 15 when the flat cables 15 are reversed by way of the reversed portions 9. The slidable member 13 is provided with multiple (five in this case) pivotally supporting portions or spindle 25 at equal intervals in the circumferential direction. The multiple idlers 15 are pivotally supported by the pivotally supporting portions 25 in a way that the idlers 15 are rotatable on their axes. Incidentally, although four of the five pivotally supporting portions 25 pivotally support the corresponding idlers 15 in FIG. 3, all the pivotally supporting portions 25 pivotally support the respective idlers 15 when assembly of the rotating connector 1 is completed.

The multiple idlers 15 are each of cylindrical form and pivotally supported on, with an inner cylindrical wall 27 thereof rotatable around, a corresponding pivotally supporting portion 25. A screw, a lock structure or the like fixed to the end portion of the pivotally supporting portion 25 prevents the idler 15 from coming off. A predetermined space is set between the inner periphery of the inner cylindrical wall 27 and the outer periphery of the pivotally supporting portion 25 in the radial direction. For this reason, the space 17 between the outer peripheries of the outer cylindrical walls 29 of the idlers 15 and the outer periphery of the inner case 7, and the space 19 between the outer peripheries of the outer cylindrical walls 29 of the idlers 15 and the inner periphery of the outer case 3 vary with movements of the inner cylindrical walls 27 within the space.

The multiple idlers 15 are moved toward the inner case 7 as the number of turns of the flat cables 11 becomes larger when the flat cables 11 are wound along the inner periphery of the outer case 3. In accordance with the movements of the idlers 15, the space 17 between the outer peripheries of the outer cylindrical walls 29 of the idlers 15 and the outer periphery of the inner case 7 becomes smaller. This makes it possible to prevent the reversed portions 9 of the flat cables 11 from entering the space 17 when the inner case 7 is rotated in the opposite direction.

On the other hand, the multiple idlers 15 are moved toward the outer case 3 as the number of turns of the flat cables 11 becomes larger when the flat cables 11 are wound along the outer periphery of the inner case 7. In accordance with the movements of the idlers 15, the space 19 between the outer peripheries of the outer cylindrical walls 29 of the idlers 15 and the inner periphery of the outer case 3 becomes smaller. This makes it possible to prevent the reversed portions 9 of the flat cables 11 from entering the space 19 when the inner case 7 is rotated in the opposite direction.

The space 17 becomes the smallest when the number of turns of the flat cables 11 along the inner periphery of the outer case 3 is maximized. Meanwhile, the space 19 becomes the smallest when the number of turns of the flat cable 11 along the outer periphery of the inner case 7 is maximized. Accordingly, it is possible to efficiently prevent the reversed portions 9 of the flat cables 11 from entering the spaces 17, 19 at the time of a start of rotation of the inner case 7 from the state of the maximum turn in one direction to the opposite direction, when the reversed portions 9 of the flat cables 11 are most likely to enter the spaces 17, 19. It should be noted that the settings of the spaces 17, 19 may be adjusted by the space between the inner periphery of the inner cylindrical wall 27 and the outer periphery of the pivotally supporting portion 25. However, if this space is set too large, a backlash of the idler 15 is increased. For this reason, the settings may be adjusted depending on the size of the outer cylindrical wall 29 in the radial direction.

Figure 4:
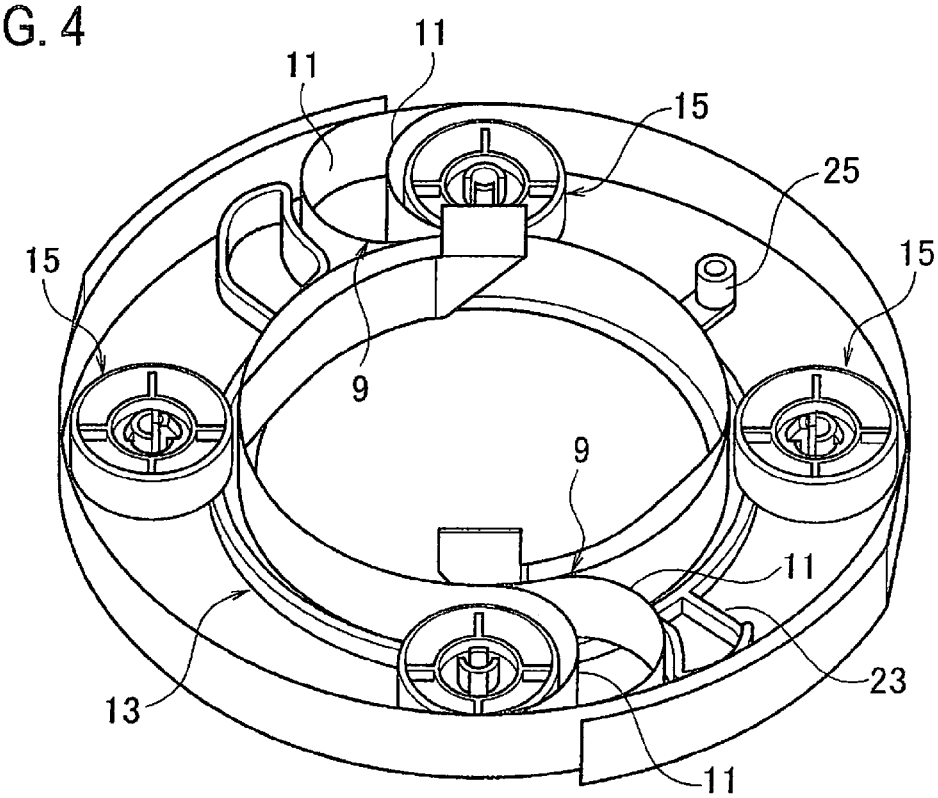
FIG. 4 is a perspective view of the rotating connector of the embodiment of the present invention, which has four flat cables.

In this respect, as shown in FIG. 4, the number of the flat cables 11 may be increased to four, for example, by adding two flat cables 11 to be connected to a steering heater circuit or the like. In the case where the four flat cables 11 are used, the multiple idlers 15 may be set such that that the space 17 becomes the smallest when the number of turns of the four flat cables 11 along the inner periphery of the outer case 3 is maximized, and that the space 19 can become the smallest when the number of turns of the four flat cables 11 along the outer periphery of the inner case 7 is maximized.

In the rotating connector 1, when the inner case 7 rotates counterclockwise from the state shown in FIG. 1, the flat cables 11 are wound along the inner periphery of the outer case 3. During this operation, the multiple idlers 15 are moved toward the inner case 7 in accordance with the increase in the number of turns of the flat cables 11 to be wound, and the space 17 between the idlers 15 and the inner case 7 is thus reduced.

Meanwhile, in the rotating connector 1, when the inner case 7 rotates clockwise from the state shown in FIG. 1, the flat cables 11 are wound along the outer periphery of the inner case 7. During this operation, the multiple idlers 15 are moved toward the outer case 3 in accordance with the increase in the number of turns of the flat cables 11 to be wound, and the space 19 between the idlers 15 and the outer case 3 is thus reduced.

In the rotating connector 1 of the embodiment, the multiple idlers 15 are pivotally supported by the slidable member in a way that the space 17 between the idlers 15 and the inner case 7 and the space 19 between the idlers 15 and the outer case 3 can be changed by the flat cables 11 to be wound along the inner periphery of the outer case 3 and the outer periphery of the inner case 7. For this reason, of the spaces 17, 19, the one between the idlers 15 and the case with the less number of turns of the flat cable 11 therearound becomes smaller. This makes it possible to prevent the reversed portions 9 of the flat cables 11 from entering the space between the multiple idlers 15 and each of the outer case 3 and the inner case 7.

Accordingly, the rotating connector 1 of the embodiment can prevent the flat cables 11 from being buckled by use of the multiple idlers 15 which are capable of changing the spaces 17, 19, and can inhibit a decrease in the durability of the flat cables 11.

In addition, the multiple idlers 15 make the space 17 between the idlers 15 and the inner case 7 the smallest when the number of turns of the flat cables 11 along the inner periphery of the outer case 3 is maximized and make the space 19 between the idlers 15 and the outer case 3 the smallest when the number of turns of the flat cables 11 along the outer periphery of the inner case 7 is maximized. Thus, it is possible to prevent the reversed portions 9 of the flat cables 11 from entering the spaces 17, 19 at the time of the start of rotation of the inner case 7 from the maximum turn in one direction to the opposite direction, when the reversed portions 9 of the flat cables 11 are most likely to enter the spaces 17, 19.

Furthermore, even when the multiple flat cables 11 are housed in the cable accommodation chamber 5, the rotating connector 1 can prevent the reversed portions 9 of the flat cables 11 from entering the spaces 17, 19 by using the multiple idlers 15, which are capable of changing the spaces 17, 19, and can inhibit a decrease in the durability of the flat cables 11. Moreover, the rotating connector 1 can deal with a need to increase the number of circuits by use of the multiple flat cables 11.

Although the five idlers 15 are provided to the slidable member 5 in the rotating connector of the present invention, the number of the idlers 15 is not limited to the foregoing. The number of idlers 15 may be selected depending on the necessity, for example, by providing more than five idlers or less than five idlers to the slidable member.

Moreover, although the two or four flat cables are housed in the cable accommodation chamber, the number of flat cables is not limited to the foregoing. The number of the flat cables may be set depending on how many circuits are to be connected to the flat cables. In addition, the space between the multiple idlers and each of the outer case and the inner case may be set depending on the number of the flat cables.

What is claimed is:

1. A rotary connector comprising:

a cylindrical outer case;

a cylindrical inner case housed in the outer case, the inner case being rotatable relative to the outer case and at a radial interval between the outer case and the inner case forming a cable accommodation chamber;

an annular slidable member rotatably disposed in the cable accommodation chamber;

a plurality of support spindles disposed circumferentially spaced apart on the annular slidable member;

at least one flexible flat cable housed in the cable accommodation chamber, the flexible flat cable being wound in opposite directions along an inner periphery of the outer case and an outer periphery of the inner case by way of a reversed portion of the flat cable, such that with clockwise and counterclockwise rotation of the rotary connector, the flexible flat cable unwinds from the inner periphery of the outer case and onto the outer periphery of the inner case, and vice-versa; and a plurality of cylindrical idlers rotatably housed in the cable accommodation chamber, each idler pivoted on a respective one of the support spindles on the annular slidable member, therein being revolvable to allow the flat cable to reverse itself, each idler and support spindle configured such as to leave a radial clearance between the spindle and an inner cylindrical wall of the idler, the radial clearance being of dimension predetermined such that with the winding of the flat cable off/onto the inner periphery of the outer case and onto/off the outer periphery of the inner case, the idler shifts radially outward/inward by the flat cable winding onto itself between the inner periphery of the outer case and the idler, and between the outer periphery of the inner case and the idler.

2. The rotary connector of claim 1, wherein the radial clearance between the spindles and inner cylindrical walls of the idlers is dimensioned so as to minimize the space between the idlers and the inner case when the flat cable has wound onto itself a maximum number of turns along the inner periphery of the outer case, and so as to minimize the space between the idlers and the outer case when the flat cable has wound onto itself a maximum number of turns along the outer periphery of the inner case.

3. The rotary connector of claim 1, wherein a plurality of the flat cables are housed in the cable accommodation chamber.

4. The rotary connector of claim 2, wherein a plurality of the flat cables are housed in the cable accommodation chamber.

* * * * *